United States Patent [19]

Benedict et al.

[11] 4,385,696

[45] May 31, 1983

[54] LINKED CONTAINER ARTICLE CARRIER

[75] Inventors: Charles E. Benedict; Kenneth G. Kimsey, Jr., both of Tallahassee; Robert A. Freeman, Gainesville, all of Fla.

[73] Assignee: Wayne H. Coloney Company, Inc., Tallahassee, Fla.

[21] Appl. No.: 294,946

[22] Filed: Aug. 21, 1981

[51] Int. Cl.[3] ..... B65D 85/62; B65D 85/20; B65D 71/02

[52] U.S. Cl. ..... 206/443; 206/150; 206/446; 206/460; 206/813

[58] Field of Search ..... 206/443, 446, 820, 813, 206/3, 150, 460

[56] References Cited

U.S. PATENT DOCUMENTS

| | | | |
|---|---|---|---|
| 2,376,962 | 5/1945 | French et al. . | |
| 2,829,562 | 4/1958 | Larue . | |
| 3,033,412 | 5/1962 | Fox | 206/820 |
| 3,143,266 | 8/1964 | Imatake | 206/446 |
| 3,229,584 | 1/1966 | Zehnder . | |
| 3,247,958 | 4/1966 | Dreher | 206/813 |
| 3,373,540 | 3/1968 | Wisner | 206/443 |
| 3,873,105 | 3/1975 | Pastelak . | |
| 4,034,138 | 7/1977 | Babayan . | |
| 4,137,821 | 2/1979 | Benedict . | |

*Primary Examiner*—William T. Dixson, Jr.
*Attorney, Agent, or Firm*—Dowell & Dowell

[57] ABSTRACT

A plurality of containers are interconnected in side by side generally parallel relationship by flexible substantially non-expandable belts so that such containers may be in abutting relationship when in stored position and may be spaced a predetermined distance apart when in use and such belts have limited axial movement while the axes remain substantially parallel with each other.

7 Claims, 10 Drawing Figures

Fig. 3
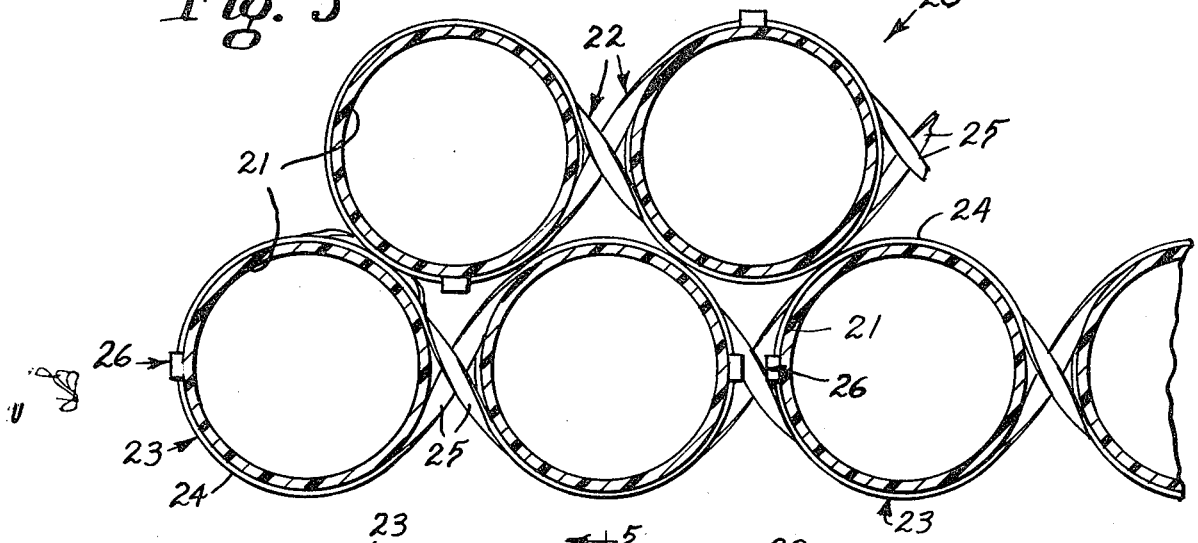
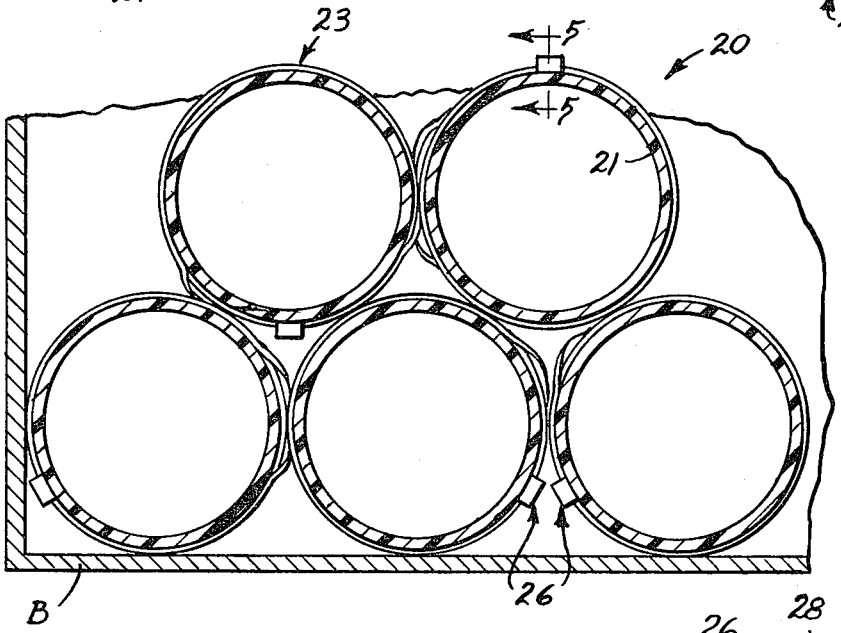
Fig. 4
Fig. 5
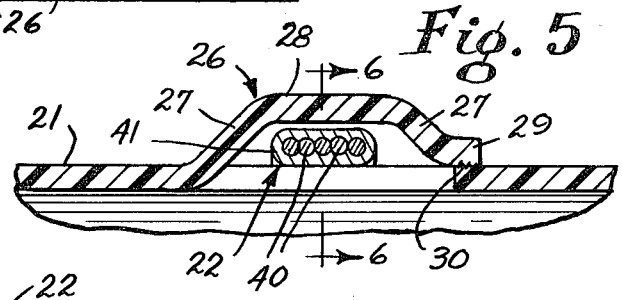
Fig. 6
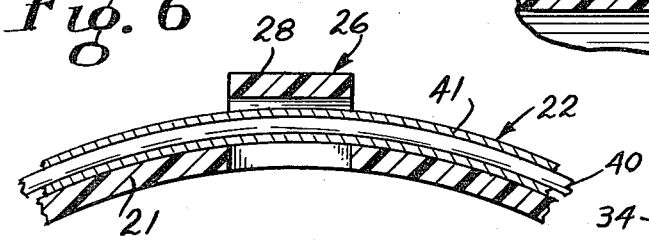
Fig. 7
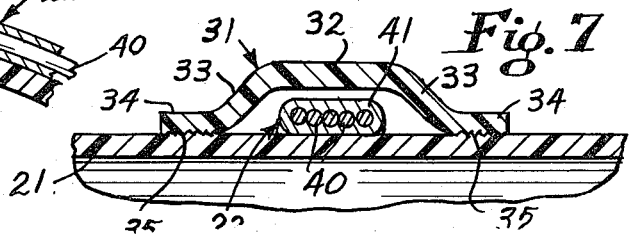

LINKED CONTAINER ARTICLE CARRIER

TECHNICAL FIELD

This invention relates generally to article carriers and relates particularly to elongated carriers having a plurality of containers which are interconnected in side by side generally parallel relationship with each other by a plurality of flexible substantially non-expandable belts.

BACKGROUND ART

In the past, article carriers of many kinds have been provided for storing, transporting and conveying articles and some of these carriers have accommodated elongated slender articles such as rounds of ammunition, glass vials, acid containers and the like in which the articles are protected from contact and particularly from rupturing or shattering caused by such contact. Additionally, article carriers have been provided which are interconnected with each other by flexible webs or hinges which permit such carriers to follow a serpentine path as well as a straight line path. Some examples of this type of carrier are disclosed in U.S. Pat. Nos. 2,376,962 to French et al; 2,829,562 to La Rue; 3,229,584 to Zehnder; and 4,137,821 to Benedict.

Additionally, efforts have been made to provide flexible belts or straps using aramid filaments or strands encapsulated in a flexible coating to provide a web having high tensile strength and low elongation. An example of this type of material is disclosed in U.S. Pat. No. 4,034,138 to Babayan.

DISCLOSURE OF THE INVENTION

The present invention is embodied in an article carrier having a plurality of hollow containers which are interconnected in side by side generally parallel relationship by flexible substantially non-expandable belts in such a manner that (a) the articles contained therein are protected, (b) the containers may be positioned in abutting relationship when stored so that the least amount of space is required, (c) the containers may be positioned in spaced relationship to each other during use so that such containers may attain a variable distance between axes up to a predetermined maximum distance, and (d) the containers may be shifted axially a limited distance relative to the other containers. The interconnecting belts are constructed of a material having high tensile strength and substantially no elongation which is encapsulated in a flexible adhesive coating and such belts are slidably connected to the containers in such a manner that the containers may be partially rotated about their longitudinal axes without becoming separated from the belts.

BRIEF DESCRIPTION OF THE DRAWINGS

FIG. 3 is a sectional view similar to FIG. 2 showing the containers in stacked relationship.

FIG. 4 is a sectional view similar to FIG. 3 showing the containers in stacked abutting relationship.

FIG. 5 is an enlarged fragmentary sectional view taken on the line 5—5 of FIG. 4.

FIG. 6 is a sectional view taken on the line 6—6 of FIG. 5.

FIG. 7 is a sectional view similar to FIG. 5 showing a different retainer.

BEST MODE FOR CARRYING OUT THE INVENTION

Figure 1:
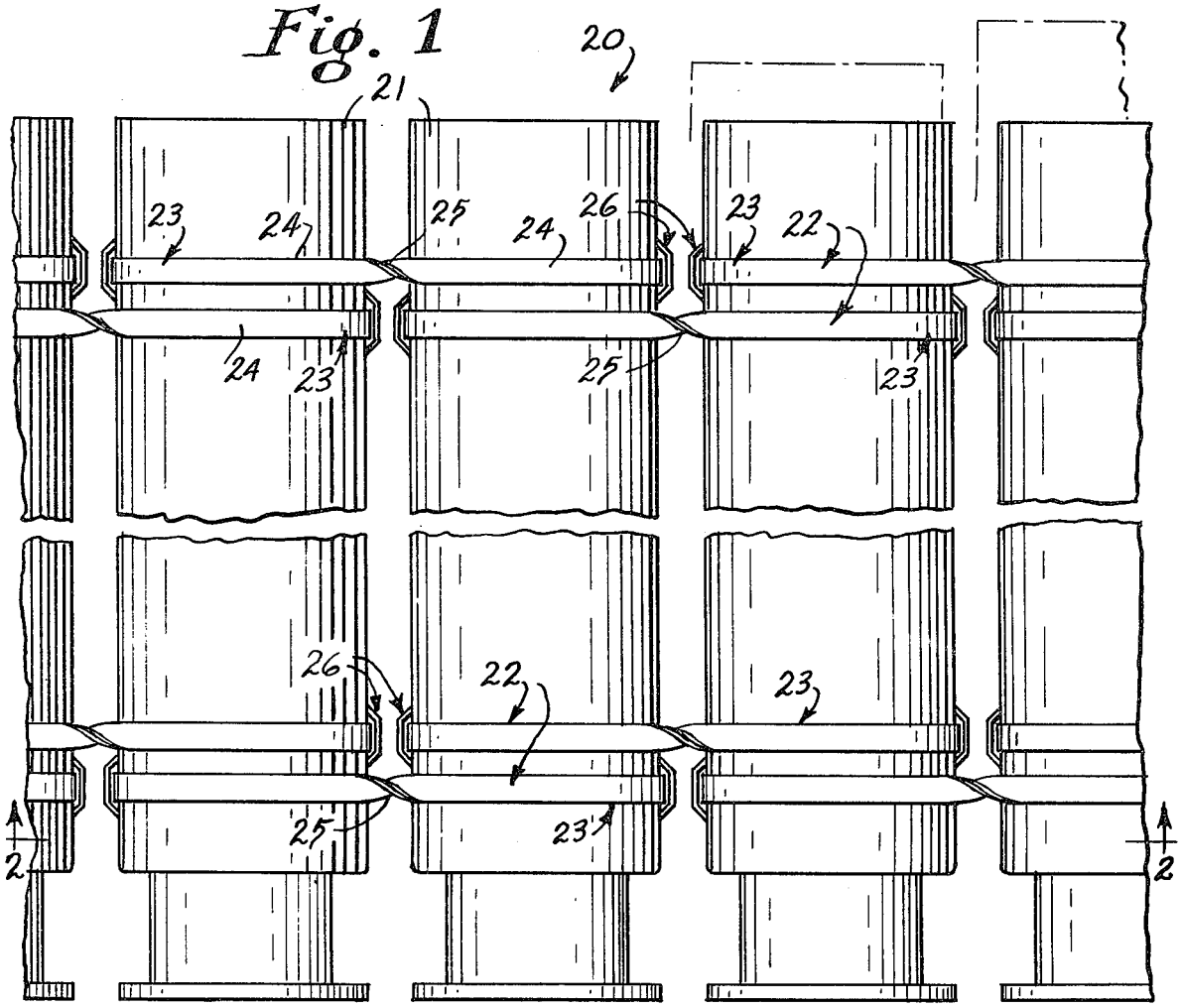
FIG. 1 is a top plan view illustrating one embodiment of the invention.
Figure 2:
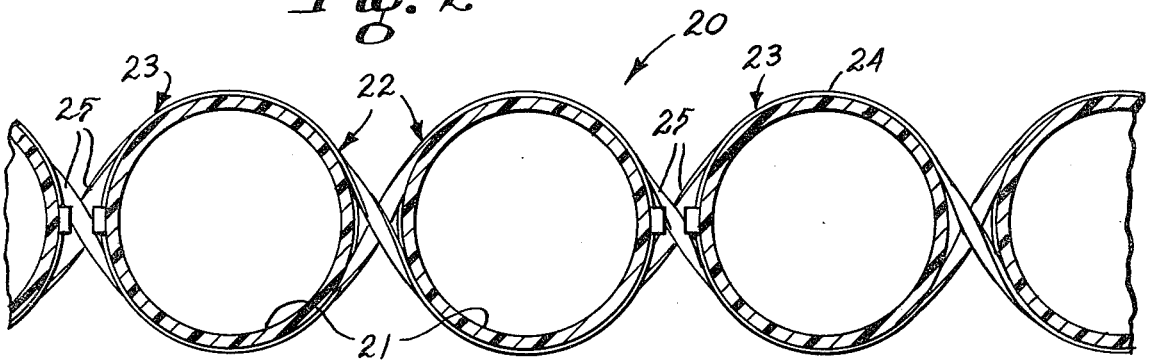
FIG. 2 is a sectional view taken on the line 2—2 of FIG. 1.

With continued reference to the drawings, an article carrier 20 is provided which includes a plurality of hollow elongated containers 21 that are connected together in spaced generally parallel relationship with each other by flexible substantially non-expandable belts 22. Although the containers may be made of metal, it is preferred that such containers be made of a tough durable thermoplastic material such as polyamide (nylon), polypropylene, vinyl or the like. Such thermoplastic material normally has a substantial degree of resiliency and a plastic memory so that it may be deformed temporarily but will return to its initial shape. This type of material provides a satisfactory protective shield for articles such as glass vials, rounds of ammunition or the like which are placed within such containers.

Further, such material normally is not abrasive and, therefore, does not have a tendency to scratch or otherwise mar the surface of the article received therein. It is apparent that the containers 21 may be of any desired size and configuration, although generally tubular containers have been illustrated. Also, it is noted that the inner periphery of the container could be of any desired configuration, such as generally cylindrical or a particular configuration to firmly hold one or more specific articles. The containers may be open at one or both ends or may be provided with a cap or closure member (not shown) for selectively closing the open ends.

With particular reference to FIGS. 1–6, each of the belts 22 is formed of a plurality of individual generally flat bands 23 and each band is urged into a generally oval shape by applying an outward force to opposite sides of the inner periphery. Thereafter, the opposite ends of the oval band 23 are twisted approximately 180° relative to each other into a figure 8 configuration to form a pair of loops 24 connected by twisted portions 25. Since the loops 24 normally are in longitudinal alignment, the twisted portions 25 cross each other between such loops.

As shown best in FIG. 1, at least two bands 23 are located at each end of the containers 21 with one of the bands at each end extending to an adjacent container on one side and the other band at each end extending to an adjacent container on the other side. Each container is received within one of the loops 24 so that the twisted portions 25 are located between contiguous containers. In order to prevent the bands from slipping off of the containers, each container is provided with a retainer or eye 26 which receives the loop 24 of each band. As shown best in FIGS. 5 and 6, the eye 26 may be struck outwardly from the body of the container 21 by using a heated cutter or forming die which initially cuts a tongue from the body material while leaving one end integrally attached thereto. Then portions of the tongue are formed upwardly out of the plane of the body of the container by stretching the heated material of the tongue to form a pair of side walls 27 and a relatively flat crown 28. The free end of the tongue forms a flange 29 which overlies the body of the container. After the loop 24 of one of the bands 23 is slid under the flange 29 to a position underlying the crown 28 of the retainer, such flange is attached to the body of the container by ultra-sonic welding, adhesives or the like indicated by the numeral 30.

With reference to FIG. 7, instead of forming the retainer from the material of the container 21, a separate retainer 31 could be provided having a raised crown portion 32 intermediate side walls 33, and outwardly extending flanges 34 at each end. Such separate retainer is positioned with the flanges against the container and with the crown portion overlying the loop 24 of a band 23. Thereafter, such flanges may be attached to the container by ultra-sonic welding, adhesives or the like indicated by the numeral 35 to prevent the bands from becoming detached.

Normally, the retainer 26 or 31 which retains each band is positioned substantially at the mid point of the loop 24 so that the container may be rotated approximately 160° in either direction before the retainers on opposite sides of the container engage the twisted portions 25 of the bands. It is important that the containers be freely rotatable relative to the loops of the bands for a limited amount so that the containers may be moved along a serpentine path or around a cam surface without substantially changing the pitch or distance between the axes of the containers. Since each container has a pair of bands adjacent each end thereof, each end of the container has a pair of retainers 26 or 31 which are located substantially 180° apart and are offset axially of the container so that the bands which extend in opposite directions do not interfere with each other.

It is desirable for the linked containers of the carrier to remain a predetermined distance apart when in use, but such containers may be a different distance apart when stored or packed, as shown in FIGS. 3 and 4. Accordingly, each of the bands 23 should be made of a flexible material that is substantially non-expandable when the carrier is being pulled when in use. Ordinarily, metallic bands are not sufficiently flexible for present purposes while cloth and thermoplastic bands have too much stretchability and frequently tend to cling to the container when the container is rotated relative to the bands.

In order to provide a belt constructed of a plurality of individual bands which are sufficiently flexible but substantially non-expandable, each band preferably is constructed of a plurality of strands 40 of flexible substantially continuous filaments which normally exhibit low percentages of elongation, such as 5% or less, of which an aramid filament is an example. The substantially non-expandable continuous filaments are bonded together by thermoplastic heat sensitive adhesives 41 such as polyamide hot melt adhesives or the like which remain flexible at normal temperatures and have a low coefficient of friction so that the belts slide easily relative to the containers.

Figure 8:
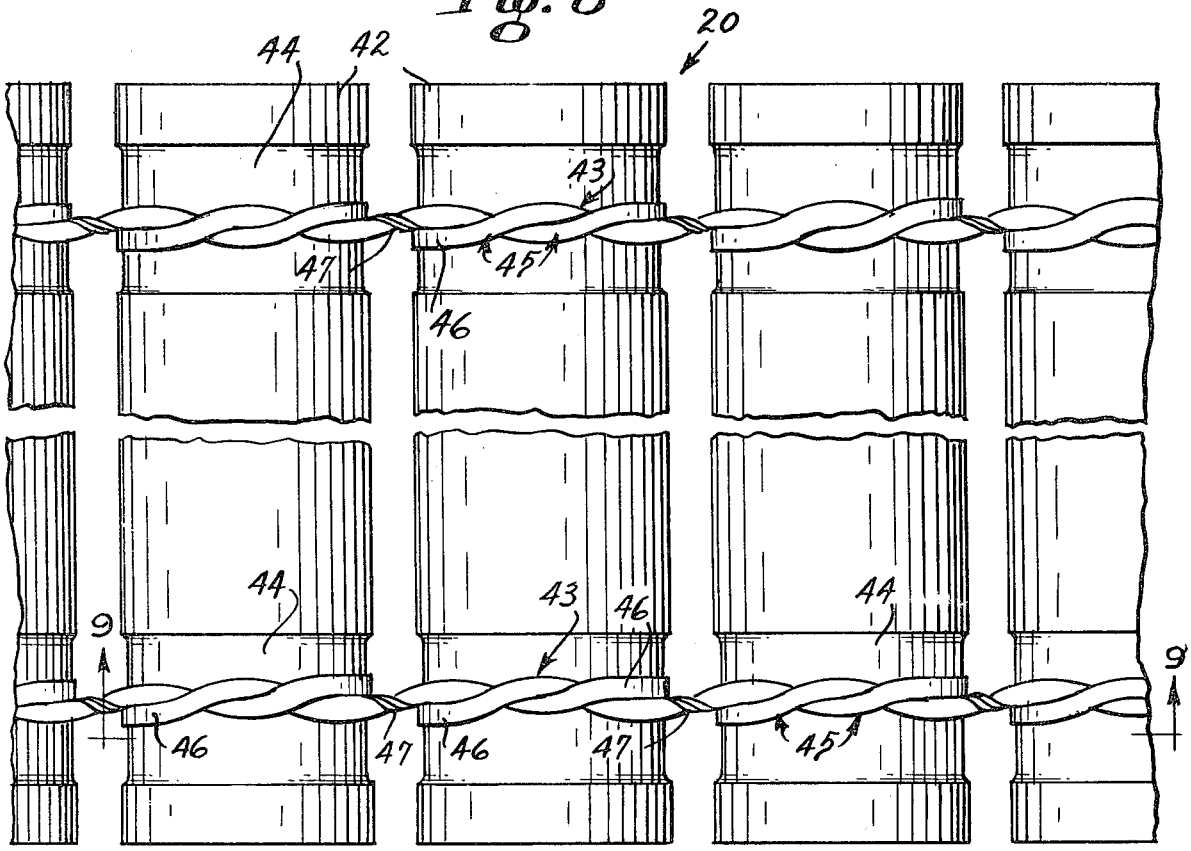
FIG. 8 is a top plan view illustrating another embodiment of the invention.
Figure 9:
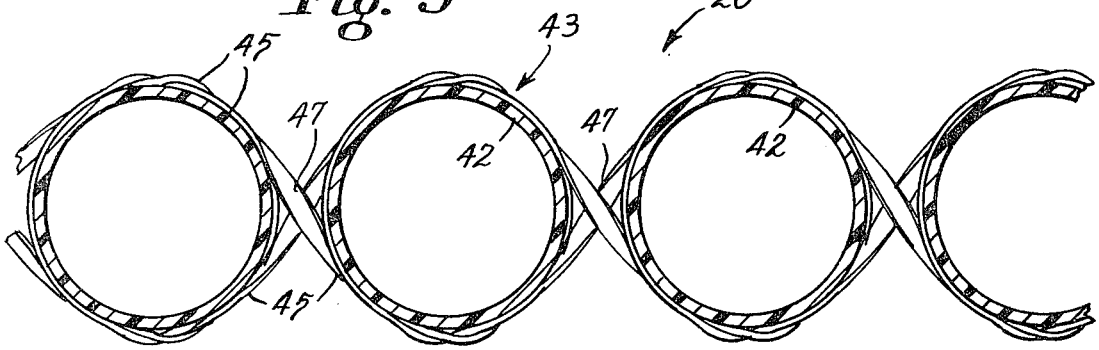
FIG. 9 is a sectional view taken on the line 9—9 of FIG. 8.
Figure 10:
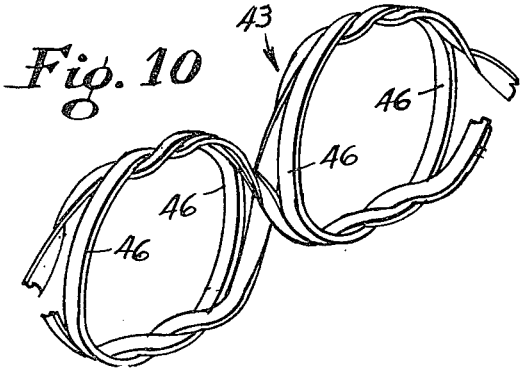
FIG. 10 is a fragmentary perspective view of one of the belts of FIG. 8.

With reference to FIGS. 8–10, another embodiment is illustrated in which a plurality of hollow elongated containers 42 are connected together by belts 43. In this embodiment, the containers are provided with a pair of spaced apart annular grooves 44 located adjacent to opposite ends of such containers. Each of the belts 43 includes a plurality of individual generally flat bands 45 which are made of substantially the same material as the bands 23 so that they flex freely, are substantially non-expandable, and have a low coefficient of friction with the material of the containers. As shown best in FIG. 10, each of the bands 45 is formed into an elongated loop and then is twisted into a figure 8 configuration to form a pair of loops 46 connected by a twisted portion 47. The axes of the loops 46 are spaced apart a distance greater than twice the diameter of a container so that portions of two spaced containers are received within the loops 46 of each band 45. Each loop 46 of one band is intertwined with one of the loops 46 of an adjacent band in such a manner that the loops face each other and form a circle of a size to receive an annular grooved portion 44 of one of the containers 42. Of course, the circle formed by the loops of adjacent bands may be expanded or contracted merely by moving the loops relative to each other so that the circle may easily be applied to and removed from the container and may accommodate containers of various diameters.

With this construction, when a pulling force is applied to the article carrier, a substantially equal pressure is exerted around the entire periphery of each container. However, the containers may be rotated a full 360° if desired for any reason. Also, the containers may be moved out of a straight line path of travel and carried through an arc by means of a sprocket or the like while maintaining substantially the same distance between the axes of the containers.

When the containers are in a stacked array such as when they are stored in a box B or other receptacle, the portions of the bands which form a circle about the container do not tend to separate from each other and loosen the container since such loops are intertwined and a portion of each loop overlaps a portion of the loop of an adjacent band. However, if it should become necessary to replace one or more of the bands and containers, the loops may be easily pulled apart to permit the container to be moved lengthwise so that the container is free from the article carrier. If the removed container is defective, a new container may be slipped into the intertwining loops so that the carrier is whole again. If one of the bands is defective, after the first container is removed, the second container from the defective band loop is removed in the same manner after which the defective band is cut or otherwise removed. One loop of a replacement band may be intertwined with a loop of a contiguous band, however, the other loop will merely extend partially around a container without being intertwined with the contiguous band.

Industrial Applicability

The article carrier 10 includes a plurality of containers which are linked together by flexible substantially non-expandable belts 22 or 43 to form a carrier of indefinite length. Each of the containers is hollow and receives one or more articles. When the carrier is in use, as illustrated in FIGS. 1, 2, 8 and 9, a pulling force is applied to a portion of the carrier and the portions not directly engaging the pulling force are propelled by such force through the connecting belts 22 or 43. Since the belts are substantially non-expandable, the axes of the containers remain a predetermined distance apart and normally in parallel relationship with each other. However, due to the flexibility of the belts, the containers may be moved axially relative to each other as illustrated in phantom in FIG. 1 or moved through an arc along the path of travel.

Due to the flexibility of the belts 22 and 43, the containers may be positioned in stacked relationship as shown in FIG. 3. In this position, the containers of the lower course remain a fixed distance apart and the containers of the next uppermost course may be rotated upwardly to a position overlying the lower course until each container of the upper course is in abutting relationship with two containers of the lower course.

When the article carrier is to be stored or transported for substantial distances, such carrier may be placed in a box or carton B as shown in FIG. 4. In this position, the first container of the lower course engages the side wall of the box and each succeeding container is moved into abutting relationship with the previous container so that the containers of the first course substantially form a solid mass. The next uppermost course is laid on top of the lowermost course in staggered relationship to engage two lowermost containers or such containers of the upper course may be in vertically aligned abutting relationship with the containers of the lower course. When this occurs, the flexible belts are slack between contiguous containers.

We claim:

1. An article carrier comprising a plurality of elongated hollow containers, a plurality of belts connecting each container to at least one other container, each of said belts forming at least portions of a pair of loops the axes of which are spaced apart a distance greater than the diameter of said containers, one of said containers being received within each loop, and each of said belts being made of flexible substantially non-expandable continuous filament material encased within a flexible adhesive, whereby said containers may be disposed in abutting relationship with each other or may be spaced apart a selected distance up to a fixed predetermined distance apart.

2. The invention of claim 1 including a plurality of retainers fixed to each container for slidably holding said belts.

3. The invention of claim 2 in which said retainer is fixed at each end to said container.

4. The invention of claim 1 in which said belts are intertwined with each other.

5. The invention of claim 1 in which said non-expandable continuous filament material is an aramid filament.

6. The invention of claim 1 in which said flexible adhesive is a polyamide hot melt adhesive.

7. An article carrier comprising a plurality of elongated hollow containers, each of said containers being constructed of thermoplastic material, each container having spaced annular grooves intermediate its ends, at least two belts connecting said containers together in assembled relationship, each of said belts including a plurality of individual bands formed into an elongated loop having semi-circular portions at each end, at least one semi-circular end portion of each band being intertwined with the end portion of a contiguous band, the opposed semi-circular end portions of contiguous bands substantially defining an adjustable circle which is received within one of said annular grooves, each of said bands including a plurality of strands of non-expandable continuous filament material encased within a flexible adhesive, and each of said bands being of substantially equal size, whereby a plurality of bands are intertwined to form at least two belts which connect a plurality of containers together in assembled generally parallel relationship in a manner such that said containers may be selectively disposed in abutting relationship with each other or may be spaced apart up to a predetermined distance.

* * * * *